US005304073A

United States Patent [19]

Golobay et al.

[11] Patent Number: 5,304,073

[45] Date of Patent: Apr. 19, 1994

[54] ELECTRICAL CONNECTOR AND PUMP ASSEMBLY UTILIZING SAME

[75] Inventors: Lloyd D. Golobay, Huntington Beach; William B. Stucker, La Mirada; Taner Bayraktaroglu, Westminster, all of Calif.

[73] Assignee: Carr-Griff, Inc., Santa Ana, Calif.

[21] Appl. No.: 893,729

[22] Filed: Jun. 5, 1992

[51] Int. Cl.[5] ..... H01R 13/52; H01R 13/56

[52] U.S. Cl. ..... 439/282; 439/447; 439/814

[58] Field of Search ..... 439/445–448, 439/587–589, 278–282, 274, 275, 814

[56] References Cited

U.S. PATENT DOCUMENTS

| | | | |
|---|---|---|---|
| 2,035,345 | 3/1936 | Schafer | 439/447 |
| 2,386,000 | 10/1945 | McQuiston | 439/447 |
| 3,142,288 | 4/1964 | Johnston | 285/253 |
| 3,321,811 | 5/1967 | Thomas | 285/252 |
| 3,775,828 | 12/1973 | Kopenhaver | 439/445 |
| 3,963,295 | 6/1976 | Askman et al. | 439/281 |

OTHER PUBLICATIONS

Marshall Underwater Industries Inc., "Magnetically Activated Underwater Pluggable Switch 26-5RS".

Marshall Underwater Industries Inc., "Underwater Pluggable Connectors" brochure.

Underwater Systems Inc. catalog, page entitled "WPC Connector", copyright 1991.

Cooper Industries, Crouse-Hinds Molded Products, "Electro Underwater Electrical Connectors" catalog, p. 26, Mar. 1988.

*Primary Examiner*—Neil Abrams

*Attorney, Agent, or Firm*—Gordon L. Peterson

[57] ABSTRACT

An electrical connector for connecting first and second conductors of a cable to first and second electrically conductive leads comprising first and second connector members with each of the connector members including a connector body and first and second conductive members carried by the connector body. Each of the conductive members has a terminal. The conductive members of the first connector member are coupled to the first and second leads, respectively and the conductive members of the second connector member can be coupled to the conductors of the cable, respectively. A flexible, elastic inner sleeve snugly receives a proximal region of the connector body of the second connector member and a distal region of the cable. A flexible outer sleeve, which is less flexible than the inner sleeve, snugly receives the inner sleeve. The connector bodies have a projection and recess so that they can be interconnected to place the terminals in electrical contact.

21 Claims, 2 Drawing Sheets

ELECTRICAL CONNECTOR AND PUMP ASSEMBLY UTILIZING SAME

BACKGROUND OF THE INVENTION

Submersible pumps are commonly used to pump water from water wells. One kind of submersible pump is powered by an electric motor. In the absence of utility company power, energy to drive the motors can be derived from solar panels. Submersible pumps utilizing solar power may be utilized in remote and even primitive parts of the world.

In a submerged pump of this type, both the pump and the motor are submerged in the well. One problem with pumps of this kind is installing them in the field in a manner that will assure a waterproof electrical connection between the motor and an electric cable extending from the solar panels down into the well to the motor pump assembly. It is also important that this electrical connection be quickly and easily made with a minimum of tools and skill, be easily field repairable, require only low maintenance and be very strong.

One prior art field installation technique includes splicing the conductors of the cable to the leads from the motor and then attempting to seal the connection. Unfortunately, this approach requires too much time, and more importantly, has not proved effective in sealing the electrical connection against water entry.

Another approach is to attach a long cable to the motor at the factory. This has the advantage of providing a factory seal. However, it also requires the shipment of a long length of cable along with the pump and motor. Furthermore, the shipped length of cable may be too long thereby wasting cable or too short in which event field splicing is necessary to provide a cable of adequate length.

SUMMARY OF THE INVENTION

This invention solves these problems by providing an electrical connector which can be quickly and easily installed in the field with only simple tools, such as a screwdriver. Virtually no skill is required to install the connector, and the connector is waterproof. Although the connector of this invention is particularly adapted for use with submersible pumps and for installation in the field, it has other applications where waterproof electrical connection is desired.

The invention may be embodied in an electrical connector which includes a first connector member including a connector body and first and second conductive members carried by the connector body. The conductive members can be coupled to first and second leads, such as the leads from the motor of a pump, and each of the conductive members has a terminal.

The connector also includes a second connector member which includes a connector body and first and second conductive members carried by the connector body. Each of these conductive members has a terminal. Means is provided for coupling the conductive members of the second connector member to the first and second conductors of a cable, respectively. Although this coupling means may include a weld or a braze or virtually any kind of electrical connection, preferably the coupling means is of the type which can be easily coupled in the field using minimal simple tools. For example, the coupling means may be crimpable with pliers or of a clamping type which can be clamped using a screwdriver. In a preferred construction, the coupling means includes a screw which can be clamped against, either directly or through one or more intermediate members, the conductors of the cable.

Another feature of the electrical connector is a flexible, elastic inner sleeve sized and adapted to snugly receive a proximal region of the connector body of the second connector member and a distal region of the cable. This inner sleeve also receives the coupling means. The inner sleeve forms a watertight seal with both the connector body and the cable and also forms a sealed housing for the coupling means which couple the conductors of the cable to the conductive members.

An important feature of the inner sleeve is its elasticity. The elasticity of the inner sleeve enables it to be stretched over cables of different cross sectional sizes and shapes and to form a seal around cables of such different sizes and shapes. This is important because the cross sectional sizes and shapes of the cables with which the connector must be used are not uniform. For example, the cable may be of circular, oval, polygonal or irregular configurations and may have various different cross sectional dimensions as well as local irregularities along it peripheral surface. The flexibility and elasticity of the inner sleeve enables the connector of this invention to be, in effect, a more universal waterproof connector.

The connector also includes a flexible outer sleeve sized and adapted to snugly receive the inner sleeve. The outer sleeve is less flexible than the inner sleeve to increase the durability of the connector and to provide a shoulder which can be used, if desired, to mechanically lock or couple the two connector members together. The outer sleeve is also stronger, harder and less flexible and elastic than the inner sleeve, but the two sleeves are similarly configured so that they can form a watertight seal at least over those regions where the inner sleeve is not conforming to some irregular configuration of the cable. To further to assure water tightness between these two sleeves, the connector body of the second connector member has an integral seal which assists in sealing between the inner sleeve-connector body interface and which deforms the inner sleeve outwardly to provide a backup seal between the two sleeves. Various other integral seals may be employed on the connector bodies for sealing other interfaces.

One of the connector bodies has a recess and the other of the connector bodies has a projection receivable in the recess to define a connected position. In the connected position, the terminals are in electrical contact.

Means is preferably provided for retaining the connector bodies in the connected position. Although the retaining means can be any mechanical structure which permanently or releasably holds the connector bodies in the connected position, preferably the retaining means is of the type which can be easily attached in the field with minimal tools and effort. For example, although various sorts of bayonet, sliding and cam arrangements may be utilized, preferably a threaded connection which can be made by hand is employed.

The connector body of the second connector member preferably has an external recess and the outer sleeve has a projection receivable in the recess. In a preferred construction, the connector body includes a main body and a ring on the main body. The ring has a circumferentially extending annular groove and the outer sleeve has a rib receivable in the groove. This firmly interlocks the outer sleeve to the connector body so load can be transmitted through the connector body and the coupling means to the cable. Strain relief for the coupling means is not required. Preferably the main body includes a hard polymeric material and the ring is a metal, such as brass.

The connector is particularly adapted for use with a submersible pump assembly which includes a pump and an electric motor coupled to the pump to drive the pump. In this event, either the pump or the motor has a cavity and the first connector member is mounted in the cavity.

The invention, together with additional features and advantages thereof may best be understood by reference to the following description taken in connection with the accompanying illustrative drawings.

DESCRIPTION OF THE PREFERRED EMBODIMENT

Figure 1:
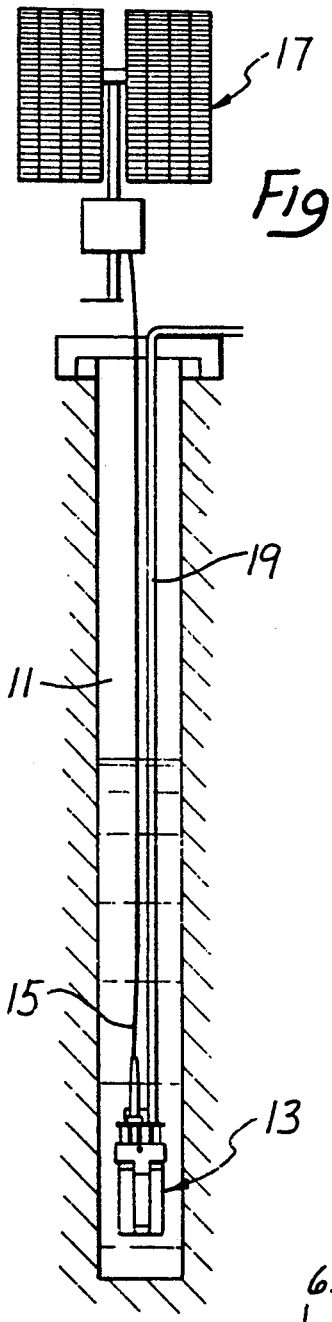
FIG. 1 is a schematic illustration illustrating one form of pump assembly of this invention submerged in a well and coupled to a solar power unit. The pump is greatly enlarged in FIG. 1.

FIG. 1 shows a water well 11 having a pump assembly 13 submerged in the well. The pump assembly 13 is coupled to an electrical cable 15 leading to a conventional solar power unit 17 at the surface near the well 11. A discharge conduit 19 leads from the pump assembly 13 to the surface for conducting water from the well 11 pumped by the pump assembly to the surface. The pump assembly 13 is suspended in the well 11 by the conduit 19 and/or a rope (not shown).

Figure 2:
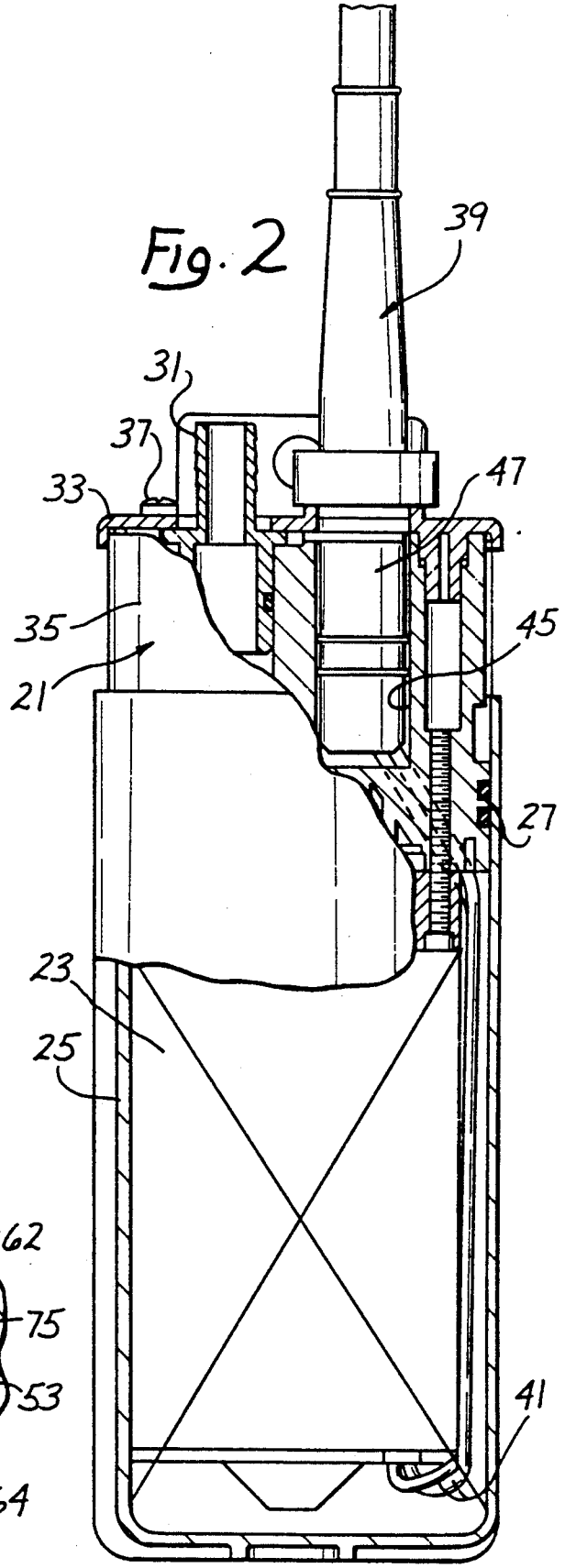
FIG. 2 is an elevational view partially in section illustrating one form of pump assembly of this invention coupled to a cable.

As shown in FIG. 2, the pump assembly 13 generally includes a pump 21 and an electric motor 23 for driving the pump. The pump 21 and the motor 23 may be conventional, and preferably the pump is a multi-chamber diaphragm pump and may be of the general type shown by way of example in Hartley U.S. Pat. No. 4,153,391. The pump assembly 13 includes a housing 25 for the motor 23 and this housing receives a portion of the pump 21 with annular seals 27 sealing the interface between the housing and the pump. The pump 21 has an inlet (not shown) and an outlet 31 which is coupled to the conduit 19. The pump 21 also includes a cover plate 33 attached to a main body 35 of a pump housing in any suitable manner such as by a plurality of screws 37 (only one being shown in FIG. 2).

An electrical connector 39 is provided for electrically coupling motor leads 41 to conductors 43 (FIG. 3) of the cable 15. In this regard, the pump 21 has a cavity 45 and the motor leads 41 extend from the motor 23 into the cavity 45.

Figure 3:
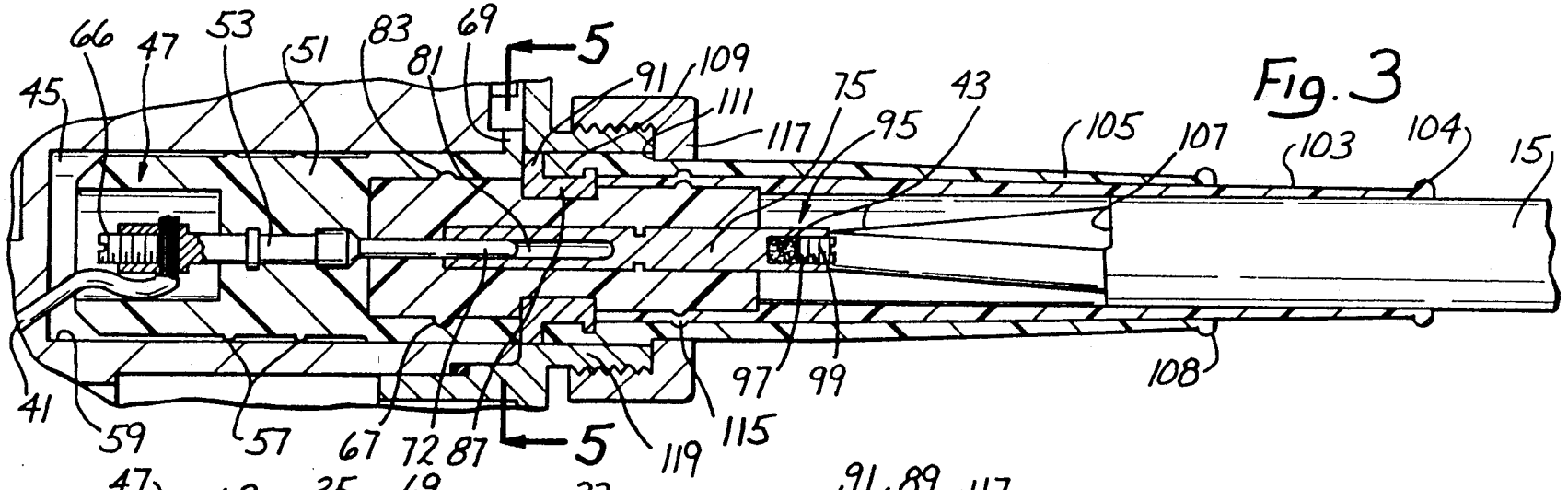
FIG. 3 is a fragmentary sectional view taken on an axial plane and illustrating the electrical connector in the connected position.
Figure 4:
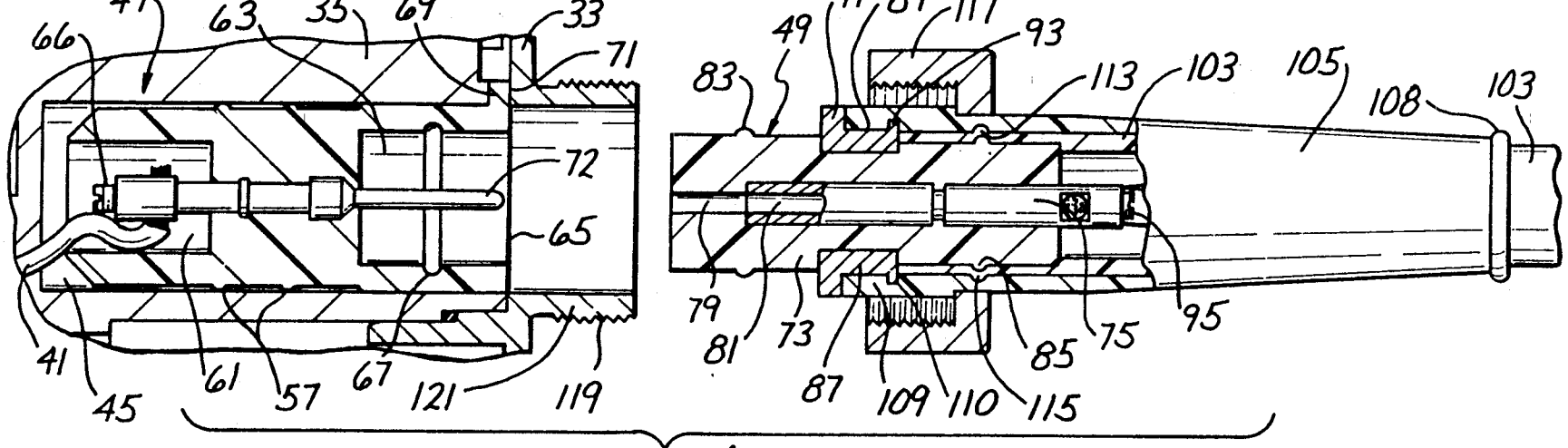
FIG. 4 is a sectional view similar to FIG. 3 with the connector members disconnected.

The connector 39 includes a connector member 47 mounted in the cavity 45 and a connector member 49 (FIGS. 3 and 4). The connector member 47 includes a connector body 51, which is preferably constructed of an elastomeric material such as neoprene or buna-N rubber, and first and second conductive members in the form of conductive pins 53 and 55 which may be molded into the connector body. The connector body 51 has annular seals 57 molded integrally with the connector body and sealingly engaging a peripheral surface 59 of the cavity 45.

Figure 5:
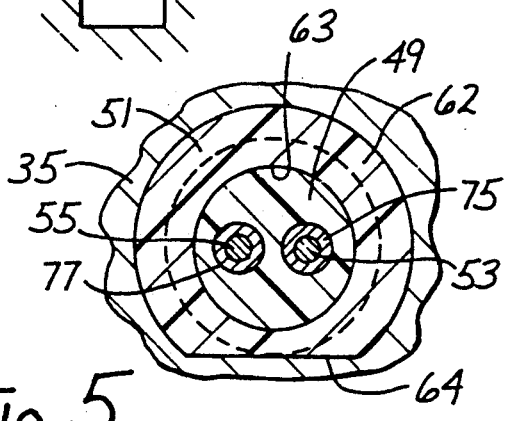
FIG. 5 is a sectional view taken generally along line 5—5 of FIG. 3.

The connector body 51 has an inwardly opening cavity 61 and an outwardly opening cavity 63. The cavity 63 is defined by a tubular section 62 (FIG. 5) having an outer surface which is cylindrical except for a flat surface 64 which orients the connector body 51 in the cavity 45. The pins 53 and 55 project into the cavities 61 and 63 and are attached to the leads 41, respectively, in the cavity 61 in any suitable manner such as by screws 66 received in the ends of the respective pins to clamp the leads to the pins. The pins 53 and 55 terminate proximally in the plane of an end surface 65 of the connector body 51, and the cavity 63 has an annular groove 67 molded into it. The connector body 51 has a flange 69 with a face 71 defining the end surface 65, and the flange 69 is held between the plate 33 and the main body 35 of the pump housing to thereby lock the connector member 47 in the cavity 45. The regions of the pins 53 and 55 in the cavity 63 constitute terminals 72.

The connector member 49 includes a connector body 73 and first and second conductive members in the form of pins 75 and 77 (FIGS. 4 and 5) molded into the connector body 73 and projecting proximally of the connector body as shown in FIGS. 3 and 4. The connector body 73 has passages 79 leading to corresponding passages 81 in the pins 75 and 77 with the portions of the pins defining the passages 81 being terminals.

The connector body 73 has seals 83 and 85 molded integrally with the connector body. The connector body 73 may be considered as having a main body, which in this embodiment is a polymeric portion, and a ring 87 on the main body. The polymeric portion may be constructed of the same material as the connector body 51. The ring 87 is constructed of a hard, non-flexible material and is preferably a metal such as brass. The ring 87 has an external recess in the form of a circumferentially extending annular groove 89 which opens outwardly and is defined at its opposite axial ends by peripheral flanges 91 and 93 with the peripheral flange 93 having a shorter radial dimension than the flange 91.

Coupling means 95 is provided proximally of the connector body 73 for coupling the conductive pins 75 and 77 to the conductors 43 of the cable 15. As shown in FIG. 3, the coupling means in this embodiment includes a bore 97 in the proximal end of each of the pins 75 and 77 and a screw 99 threadedly received in each of the pins 75 and 77 for clamping a portion of the associated conductor 43. Each of the conductors 43 is inserted through a transverse slot in the associated pin 75, 77 into the bore 97.

A flexible elastic inner sleeve 103 is sized and adapted to snugly and sealingly receive a proximal region of the connector body 73 and a distal region of the cable 15. The sleeve 103 also receives and surrounds the regions of the pins 75 and 77 which are coupled to the conductors 43 and the coupling means 95. The inner sleeve 103 may be constructed of a suitable flexible and substantially elastic material such as neoprene. It is important that the elasticity and flexibility of the inner sleeve 103 be sufficient so that it can sealingly and snugly grip proximal regions of the cable 15 which are of different sizes and different cross sectional configurations, e.g.

elliptical, circular, polygonal, etc. as well as conform to peripheral irregularities in the surface of the cable 15. The inner sleeve 103 terminates distally at the ring 87 and proximally in a radially thickened band 104 which tightly and sealingly grips the cable 15. The inner sleeve 103 preferably engages the ring.

The connector 39 also includes an outer sleeve 105 which may be constructed of a polymeric material which is harder, stronger, less flexible and less elastic than the material of the inner sleeve 103. For example, a relatively harder neoprene may be used for the outer sleeve 105.

The outer sleeve 105 is adapted to snugly and sealing receive the inner sleeve 103. The outer sleeve 105 tightly conforms to the inner sleeve 103 particularly distally of a location 107 where the conductors 43 project beyond the body of the cable 15 as shown in FIG. 3. The outer sleeve terminates proximally in a radially thickened band 108 which tightly grips the inner sleeve 103 just proximally of the location 107. As shown in FIGS. 3 and 4, the inner sleeve 103 extends proximally of the band 108 of the outer sleeve.

The outer sleeve has a projection in the form of an annular rib 109 which is receivable in the groove 89. The outer sleeve 105 has an internal annular groove 110 at the proximal end of the rib 109 which receives the flange 93, an external annular shoulder 111 and an internal annular groove 113. The seal 85 on the connector body 73 forces a region of the inner sleeve 103 into the groove 113 to form an annular seal 115, which constitutes a backup seal between the sleeves 103 and 105.

Means is provided to retain the connector bodies 51 and 73 in the connected position of FIG. 3, and in this embodiment, such means includes the shoulder 111, a nut 117 adapted to be slidably received on the outer sleeve 105 and cooperate with the shoulder 111, and external threads 119 formed on a boss 121 which provides a coaxial extension of the recess 45. By screwing the nut 117 onto the boss 121 as shown in FIG. 3, the connector bodies 51 and 73 are retained in the connected position of FIG. 3.

The connector member 47 is mounted in the cavity 45 and the motor leads 41 are coupled to the conductive pins 53 and 55 at the factory. The pump 21, the motor 23 and connector member 47 are shipped to a customer in this assembled condition along with all of the other components of the connector 39, which are disassembled. Although the cable 15 may be shipped as part of this package, this is not necessary and the user can obtain cable from other sources.

At the job site, the body or covering of the cable 15 is stripped back to the location 107 and the insulation for the conductors 43 is stripped back to expose the bare conductors. Then the nut 117, the outer sleeve 105 and the membrane 103 are slid in that order on to the distal end portion of the cable 15 and pulled way back so that the conductors 43 are exposed. The conductors 43 are then inserted into the associated bores 97 and the screws 99 are tightened to strongly electrically and mechanically couple the conductors to the pins. Next, the inner sleeve 103 is slid down over the seal 85 to the position shown in FIG. 4 where it terminates at the ring 87. Next, the outer sleeve 105 is slid over the inner sleeve 103 to the position of FIG. 4 in which the rib 109 seats in the groove 89 of the ring 87 and the groove 110 receives the flange 93. The connector body 73 is then slid into the cavity 63 to place the terminals 72 of the conductive pins 53 and 55 within the passages 81 of the conductive pins 75 and 77, respectively and the seal 83 in the grove 67. The nut 117 is then tightened down to secure the components in the position shown in FIG. 3.

In the position of FIG. 3, the inner sleeve 103 provides a seal with the outer surface of the cable 15 regardless of the shape and size of the cross section of the cable The outer sleeve 105 forms a seal with regions of the inner sleeve 103 and the seal 115 serves as a backup for this purpose. The seals 83 and 57 prevent water leakage into the conductive portions of the connector member 47. The seal 85 prevents moisture from leaking back to the area of the coupling means 95 from the interfaces at the flange 91.

With the connector 39 assembled as described above, load is transmitted from the plate 33 of the pump 21 through the nut 117 to the outer sleeve 105. The load is then transmitted from the outer sleeve 105 to the ring 87 by virtue of the interlocking engagement of the rib 109 in the groove 89 and the flange 93 in the groove 110. The load is then transmitted through the connector body 73 and the coupling means 95 to the conductors 43 of the cable 15. With this construction, no strain relief is required for the coupling means 95 because the coupling means 95 is sufficiently strong so as not to require it.

Although an exemplary embodiment of the invention has been shown and described, many changes, modifications and substitutions may be made by one having ordinary skill in the art without necessarily departing from the spirit and scope of this invention.

We claim:

1. An electrical connector for connecting first and second conductors of a cable to first and second electrically conductive leads comprising:

a first connector member including a connector body and first and second conductive members carried by the connector body, said conductive member being couplable to the first and second leads, each of said conductive members having a terminal;

a second connector member including a connector body and first and second conductive members carried by the connector body of the second connector member, each of said conductive members of the second connector member having a terminal;

means for coupling the conductive members of the second connector member to the first and second conductors of the cable, respectively;

a flexible, elastic inner sleeve sized and adapted to snugly receive a proximal region of the connector body of the second connector member and a distal region of the cable, said coupling means being receivable in the inner sleeve;

a flexible outer sleeve sized and adapted to snugly receive the inner sleeve, said outer sleeve being less flexible than said inner sleeve;

one of the connector bodies having a recess and the other of the connector bodies having a projection receivable in the recess to define a connected position in which said terminals are in electrical contact; and the connector body of the second connector member including a main body and a ring on said main body, said ring having a circumferentially extending annular groove and the outer sleeve having an annular rib receivable in the groove.

2. An electrical connector as defined in claim 1 wherein the coupling means is adapted to be proximal of the connector body of the second connector member.

3. An electrical connector as defined in claim 1 wherein the coupling means is adapted to compressively load the first conductor of the cable.

4. An electrical connector as defined in claim 3 wherein the coupling means includes a screw for use in clamping the first conductor of the cable.

5. An electrical connector as defined in claim 1 wherein the first connector body has a face which engages the ring in said connected position.

6. An electrical connector as defined in claim 1 wherein the inner sleeve is adapted to terminate distally at the ring.

7. An electrical connector as defined in claim 1 wherein the main body includes a polymeric material and the ring is metal.

8. A submersible pump assembly connectible to a cable comprising:

a pump;

an electric motor coupled to the pump to drive the pump;

a first connector member including a connector body and first and second conductive members carried by the connector body, said conductive members being coupled to the motor, each of said conductive members having a terminal;

one of said pump and motor having a cavity and said first connector member being mounted in the cavity;

a second connector member including a connector body and first and second conductive members carried by the connector body of the second connector member, each of said conductive members of the second connector member having a terminal;

means for coupling the conductive members of the second connector member to the first and second conductors of the cable, respectively;

a flexible, elastic inner sleeve sized and adapted to snugly receive a proximal region of the connector body of the second connector member and a distal region of the cable, said coupling means being receivable in the inner sleeve;

a flexible outer sleeve sized and adapted to snugly receive the inner sleeve and to surround and extend between at least a portion of the proximal region of the connector body of the second connector member and at least a portion of the distal region of the cable, said outer sleeve being less flexible than said inner sleeve;

one of the connector bodies having a recess and the other of the connector bodies having a projection receivable in the recess to define a connected position in which said terminals are in electrical contact; and means for retaining the connector bodies in the connected position.

9. A pump as defined in claim 8 wherein the retaining means includes external threads on said one of the pump and motor, a shoulder on the outer sleeve and a nut adapted to be slidably received on the outer sleeve and cooperate with the shoulder and the external threads for mechanically attaching the first and second connector members.

10. A pump as defined in claim 8 wherein said connector body of the first connector member has said recess and the connector body of the second connector member has the projection which is receivable in the recess.

11. A pump as defined in claim 8 including annular seals integral with the connector bodies, respectively and wherein one of the annular seals on the connector body of the second connector member is sealingly engageable with the inner sleeve.

12. An electrical connector comprising:

first and second electrically conductive leads;

a first connector member including a connector body and first and second conductive members carried by the connector body, said conductive member being coupled to the first and second leads, each of said conductive members having a terminal;

a second connector member including a connector body and first and second conductive members carried by the connector body of the second connector member, each of said conductive members of the second connector member having a terminal;

a cable including first and second conductors;

means for coupling the conductive members of the second connector member to the first and second conductors of the cable, respectively;

a flexible, elastic inner sleeve snugly receiving a proximal region of the connector body of the second connector member and a distal region of the cable, said inner sleeve receiving said coupling means;

a flexible outer sleeve snugly receiving the inner sleeve, said outer sleeve being less flexible than said inner sleeve;

one of the connector bodies having a recess and the other of the connector bodies having a projection receivable in the recess to define a connected position in which said terminals are in electrical contact; and the connector body of the second connector member including a main body and a ring on said main body, said ring having a circumferentially extending annular groove, the outer sleeve having an annular rib received in the groove, and the inner sleeve terminating distally at the ring.

13. An electrical connector for connecting first and second conductors of a cable to first and second electrically conductive leads comprising:

a first connector member including a connector body and first and second conductive members carried by the connector body, said conductive member being couplable to the first and second leads, each of said conductive members having a terminal;

a second connector member including a connector body and first and second conductive members carried by the connector body of the second connector member and couplable to the first and second conductors of the cable, respectively at a region of the electrical connector;

an elongated, flexible elastic inner sleeve sized and adapted to snugly receive a proximal region of the connector body of the second connector member and a distal region of the cable, said inner sleeve being sufficiently elastic to be stretched over cables of different cross sections;

an elongated, flexible outer sleeve sized and adapted to snugly receive the inner sleeve and to surround and extend between at least a portion of the proximal region of the connector body of the second connector member and at least a portion of the distal region of the cable, said outer sleeve being less flexible than said inner sleeve; and one of the connector bodies having a recess and the other of the connector bodies having a projection receivable in the recess to define a connected position in which said terminals are in electrical contact.

14. An electrical connector as defined in claim 13 wherein the connector body of the second connector member has an external recess and the outer sleeve has a projection receivable in the recess.

15. An electrical connector as defined in claim 13 including a shoulder on the outer sleeve and a nut adapted to be slidably received on the outer sleeve and cooperate with the shoulder for use in mechanically attaching the first and second connector members.

16. An electrical connector as described in claim 13 wherein the inner sleeve extends proximally of the outer sleeve.

17. An electrical connector as described in claim 13 wherein said connector body of the second connector member has an integral seal and the outer sleeve has an internal groove and said integral seal forces a region of the inner sleeve into the internal groove to form a seal.

18. An electrical connector comprising:

first and second electrically conductive leads;

a first connector member including a connector body and first and second conductive members carried by the connector body, said conductive member being coupled to the first and second leads, each of said conductive members having a terminal;

a second connector member including a connector body and first and second conductive members carried by the connector body of the second connector member, each of said conductive members of the second connector member having a terminal;

a cable including firs and second conductors coupled to the first and second conductive members of the second connector member, respectively;

an elongated, flexible, elastic inner sleeve snugly receiving a proximal region of the connector body of the second connector member and a distal region of the cable;

an elongated, flexible outer sleeve snugly receiving the inner sleeve and surrounding and extending between at least a portion of the proximal region of the connector body of the second connector member and at least a portion of the distal region of the cable, said outer sleeve being less flexible than said inner sleeve; and one of the connector bodies having a recess and the other of the connector bodies having a projection receivable in the recess to define a connected position in which said terminals are in electrical contact.

19. A submersible pump assembly connectible to a cable comprising:

a pump;

an electric motor coupled to the pump to drive the pump;

a first connector member including a connector body and first and second conductive members carried by the connector body, said conductive members being coupled to the motor, each of said conductive members having a terminal;

one of said pump and motor having a cavity and said first connector member being mounted in the cavity;

a second connector member including a connector body and first and second conductive members carried by the connector body of the second connector member, each of said conductive members of the second connector member having a terminal;

means for coupling the conductive members of the second connector member to the first and second conductors of the cable, respectively;

a flexible, elastic inner sleeve sized and adapted to snugly receive a proximal region of the connector body of the second connector member and a distal region of the cable, said coupling means being receivable in the inner sleeve;

a flexible outer sleeve sized and adapted to snugly receive the inner sleeve, said outer sleeve being less flexible than said inner sleeve;

one of the connector bodies having a recess and the other of the connector bodies having a projection receivable in the recess to define a connected position in which said terminals are in electrical contact;

means for retaining the connector bodies in the connected position;

said first connector body having said recess and the second connector body having the projection which is receivable in the recess; and the connector body of the second connector member including a main body of a polymeric material and a metal ring attached to the main body, the connector body of the first connector member having a face surrounding said recess, said ring having a flange adapted to be between a distal end of the outer sleeve and the face of the connector body of the first connector member in said connected position.

20. A pump as defined in claim 19 wherein the inner sleeve is adapted to terminate directly at the ring.

21. A pump as defined in claim 20 wherein the ring has a circumferentially extending annular groove and the outer sleeve has an annular rib receivable in the groove.

* * * * *